United States Patent [19]

Jaeger

[11] Patent Number: 4,934,573

[45] Date of Patent: Jun. 19, 1990

[54] SUPPORT FOR CARRYING LOADS ON THE BACK, IN PARTICULAR FOR RUCKSACKS

[76] Inventor: Knut Jaeger, Bruckwiesen 1, D-7312 Kirchheim/Teck, Fed. Rep. of Germany

[21] Appl. No.: 286,747

[22] Filed: Dec. 19, 1988

Related U.S. Application Data

[63] Continuation-in-part of Ser. No. 44,037, filed as PCT EP86/00483 on Aug. 13, 1986, published as WO87/01017 on Feb. 26, 1987, abandoned.

[30] Foreign Application Priority Data

Aug. 24, 1985 [DE] Fed. Rep. of Germany ..... 8524342

[51] Int. Cl.[5] ..... A45F 3/00

[52] U.S. Cl. ..... 224/210; 224/153; 224/214; 224/261

[58] Field of Search ..... 224/153, 201, 202, 204, 224/205, 208–216, 257, 259, 261–263, 265, 266, 271, 272; D3/32

[56] References Cited

U.S. PATENT DOCUMENTS

| | | | |
|---|---|---|---|
| 3,033,431 | 5/1962 | Henderson et al. | 224/211 |
| 3,144,014 | 8/1964 | Mantell, Jr. | 224/210 |
| 3,219,243 | 11/1965 | Mack | 224/263 X |
| 3,550,997 | 12/1970 | Strand | 224/153 |
| 3,653,566 | 4/1972 | Owens | 224/262 |
| 3,938,718 | 2/1976 | Madison | 224/262 |
| 3,946,916 | 3/1976 | Lawrence | 224/262 |
| 3,957,183 | 5/1976 | Gadberry | 224/211 |
| 4,018,370 | 4/1977 | Wood | 224/263 |
| 4,223,819 | 9/1980 | Wright | 224/211 |
| 4,361,259 | 11/1982 | Chanter | 224/211 |
| 4,362,307 | 12/1982 | Wakatani | 224/153 X |
| 4,368,835 | 1/1983 | Murphy | 224/153 |
| 4,750,654 | 6/1988 | Menetrier | 224/211 |

FOREIGN PATENT DOCUMENTS

| | | | |
|---|---|---|---|
| 145549 | 12/1935 | Austria | 224/210 |
| 0026092 | 4/1981 | European Pat. Off. | 224/210 |
| 2649067 | 5/1978 | Fed. Rep. of Germany | 224/210 |
| 2930520 | 2/1981 | Fed. Rep. of Germany | 224/151 |
| 1172115 | 2/1959 | France | 224/210 |
| 1334172 | 6/1963 | France | 224/210 |
| 622453 | 5/1949 | United Kingdom | 224/210 |
| 932882 | 7/1963 | United Kingdom | 224/212 |
| 1604449 | 12/1981 | United Kingdom | 224/153 |

*Primary Examiner*—Ernest G. Cusick

*Attorney, Agent, or Firm*—Scully, Scott, Murphy & Presser

[57] ABSTRACT

A support for carrying loads on the back is provided and has a back-plate which on one side follows the shape of the human body and on the other side has means for securing the loads. The support has a plurality of differently-sized openings arranged in mirror-image symmetry in relation to its central axis and intended for securing the loads to be carried. The openings are positioned and laid out in such a manner as to provide a system for arranging the loads to be carried.

5 Claims, 3 Drawing Sheets

SUPPORT FOR CARRYING LOADS ON THE BACK, IN PARTICULAR FOR RUCKSACKS

FIELD OF THE INVENTION

The present invention is a continuation-in-part of U.S. Ser. No. 044,037 filed as PCT EP86/00483 on Aug. 13 1986, published as WO87/01017 on Feb. 26, 1987, now abandoned and relates to a support for carrying loads on the back in which the support conforms to the shape of the user's back.

BACKGROUND OF THE INVENTION

Supports are known that are formed from metal tubing and to which the loads to be carried can be secured on one side and body padding on the other side. These fastenings are costly, complicated and unmanageable, since numerous fastening points are multiply occupied. In fact it is desirable on weight grounds to make the support as simple as possible and with as few tubes as possible.

On the other hand supports are known that are formed as back-plates that conform to the back of the carrier so as to enclose this, at least partly, like a corset. This however considerably restricts the freedom of movement of the carrier, particularly in difficult terrain.

SUMMARY OF THE INVENTION

The object of the present invention is to provide a support that affords as much freedom as possible and which conforms to the body of the wearer, and which also makes possible the well-ordered attachment of loads to be carried with optimal distribution of this load.

It is advantageous if the back-plate has, along each of its lateral boundary lines, a flange on the load side that forms a substantially flat U-section with the back-plate which extends in a direction outwardly and away from the back of the user.

A particularly suitable arrangement of the support according to the present invention is one in which two groups of openings are provided on the load side of the back-plate, the first group forming a grid for the attachment of containers according to a modular system, while the second group enables loads to be attached in any desired manner.

BRIEF DESCRIPTION OF THE DRAWINGS

Further details and features of the invention will appear from the following description in connection with the accompanying drawings, in which.

DETAILED DESCRIPTION OF THE PREFERRED EMBODIMENTS

Figure 1:
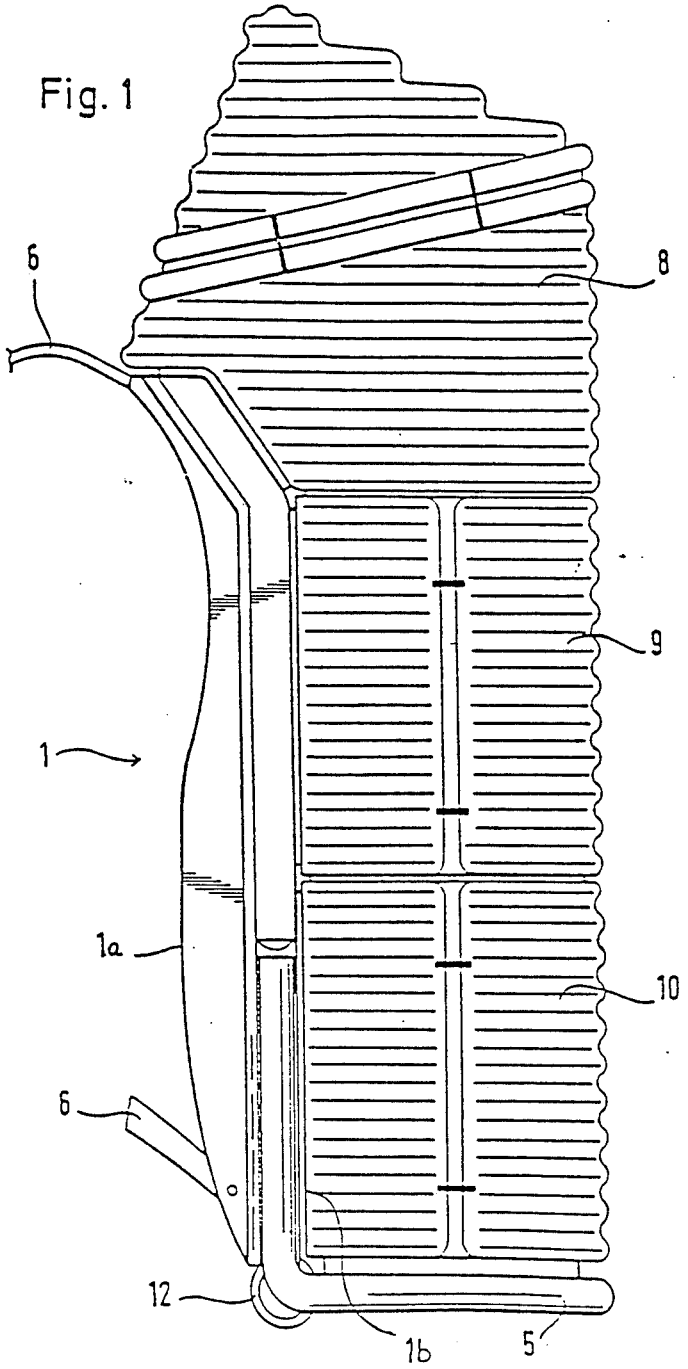
FIG. 1 is view of the support according to the invention with loads attached to it.
Figure 2:
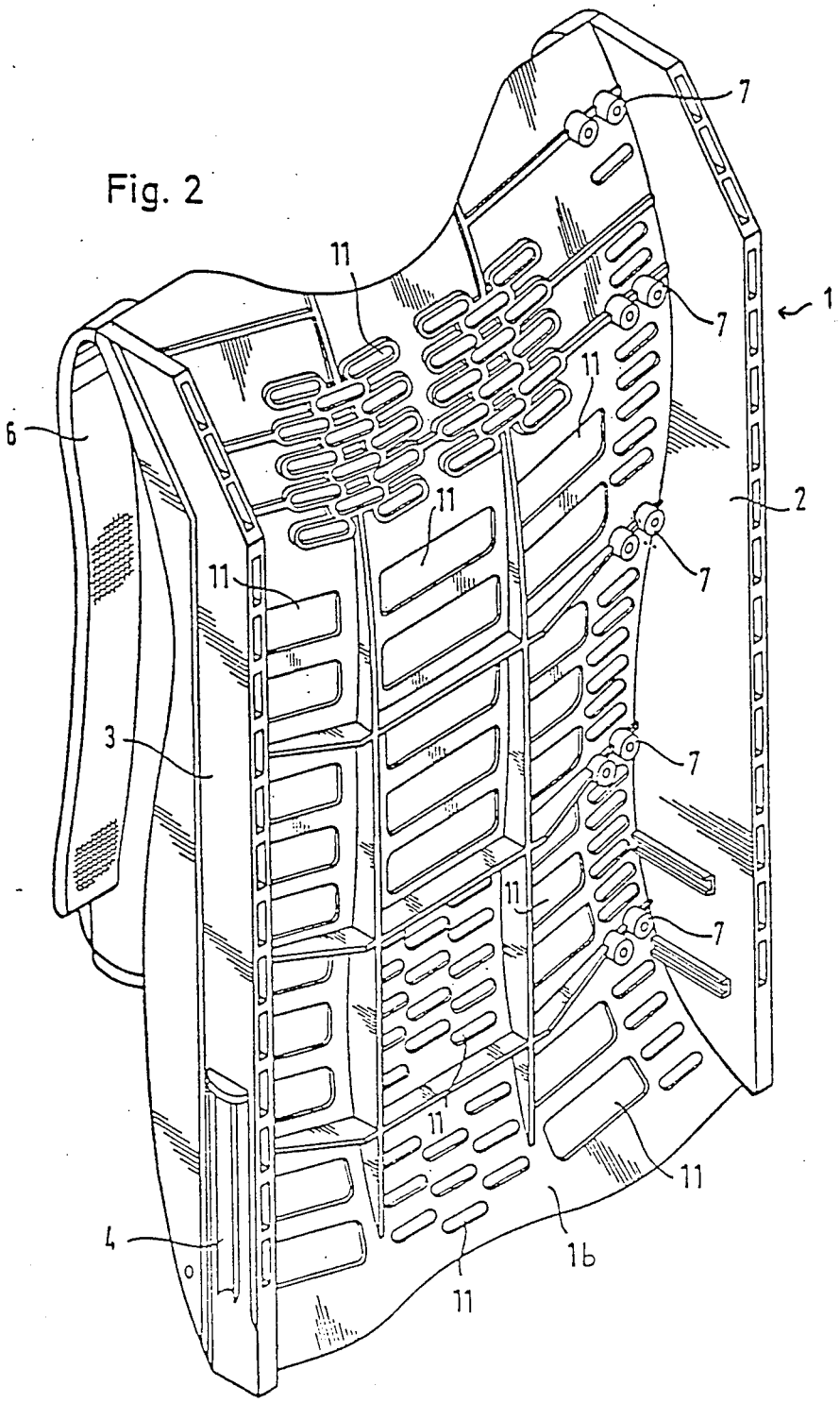
FIG. 2 is a perspective view of the support according to the invention from the load side.
Figure 3:
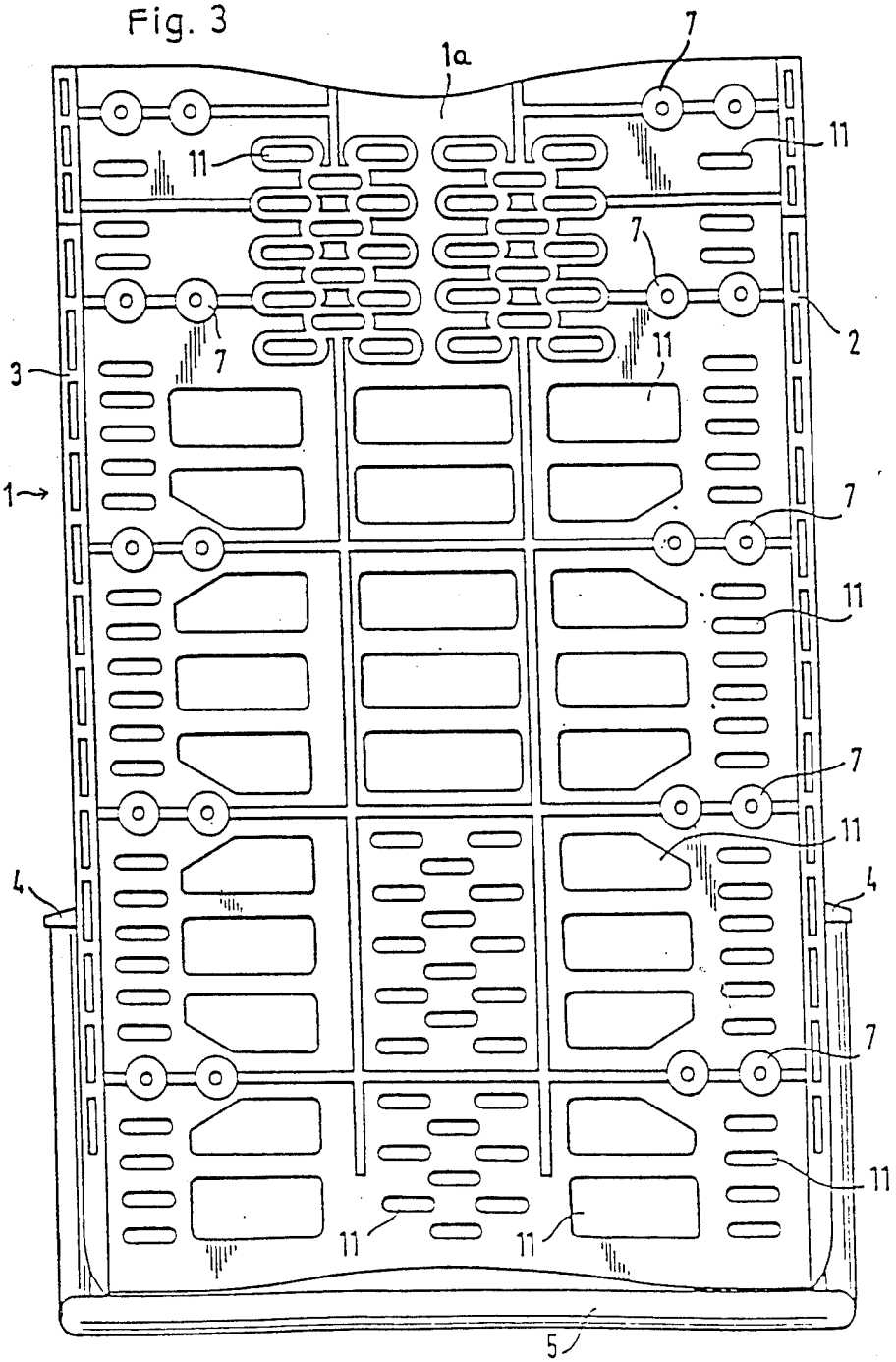
FIG. 3 is a view of the support according to the invention from behind.

The support according to the present invention consists essentially of a back-plate 1, one side 1*a* of which is a support side conforming to the body of the wearer, and the other side 1*b* is an attachment side adapted to support loads. The back-plate 1 has flanges 2, 3 that extend outward from and in a direction away from the back of the wearer, whereby the flanges form a flat U-section with the back-plate 1 and give the back-plate 1 a large measure of torsional stiffness. Flanges 2, 3 extend in a direction towards side 1*b* and away from side 1*a*.

On the lower part of the flanges 2, 3 there are mountings 4 for detachably securing a peripheral support frame 5. At suitable points on the carrier side 1*a* of the back-plate 1 are attached carrying straps 6 and optionally also a hip belt (not shown).

On the load side 1*b* of the back-plate 1 are arranged regularly distributed mountings 7 to which loads 8 can be secured by suitable fasteners. These mountings 7 are particularly suitable for securing to the back-plate 1 load containers that are attached in strictly geometrical form and preferably according to a modular system.

Extending substantially all over the back-plate 1 there are also a plurality of openings 11. These serve on the one hand to reduce the weight of the back-plate 1, but also, and this is their main purpose, to ventilate the carrier side 1*a* and for the attachment of loads on load side 1*b* at almost any desired position on the back-plate 1. These various openings 11 are preferably arranged symmetrically with regard to the center line of the back-plate 1, and have different shapes to accommodate various securement means such as belts, straps or hooks. Loads can thus be attached in numerous, systematic and clearly-defined ways by passing the straps, bands or cords through the openings.

Thus, instead of loads 9 and 10 as shown in FIG. 1, other loads such as, e.g. a tent, sleeping mats, etc., can be attached to the back-plate 1, so that the support can always be packed, and thus also carried, in a manner that is most efficient in regards to the weight distribution of the loads to be carried.

It may be advantageous to attach rollers 12 to the flanges 2, 3 at the lower edge of the back-plate 1 so that heavy loads can be moved like a cart. The support frame 5 then serves not only to support the loads securely but also to enable the frame according to the invention to stand without tipping over.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A support for carrying loads on the back, in particular for rucksacks, comprising a two-sided back-plate that on a first side follows the shape of the human body and on a second side has means for securing loads, said backplate having a plurality of differently-sized openings arranged in mirror-image symmetry in relation to a central axis of said back plate, for securing loads to be carried, said plurality of openings being positioned and arranged to provide a system for arranging and securing said loads to be carried by said support, said back-plate further having lateral edges and being provided with, on said second side, a flange extending outwardly from and along each lateral edge that forms a substantially flat U-shaped cross section with said backplate, such that said flanges extend outwardly from the back of a user, and wherein said first side conforms to and rests upon the back of a user.

2. A support according to claim 1, including a detachable support frame and wherein a mounting means is provided on each of the flanges at a lower end of the back plate for detachably securing said support frame which extends outwardly from said second side of the back plate.

3. A support according to claim 2, wherein said backplate is provided at said lower end with rollers for moving loads in the manner of a cart.

4. A support according to claim 3, wherein said detachable support frame when attached prevents said support from tipping over when said support rests on a surface in an upright position.

5. A support according to claim 1, wherein said second side of the back plate is provided with said plurality of differently sized openings which are arranged as two groups of openings, a first group forming an attachment grid for securing loads according to a modular system while a second group enables loads to be attached in any desired manner.

* * * * *